US007018216B1

(12) United States Patent
Clark et al.

(10) Patent No.: US 7,018,216 B1
(45) Date of Patent: Mar. 28, 2006

(54) COAXIAL CONNECTOR FOR CIRCUIT BOARDS

(75) Inventors: William E. Clark, West Melbourne, FL (US); Joey D. Sartin, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/145,843

(22) Filed: Jun. 6, 2005

(51) Int. Cl.
*H01R 17/04* (2006.01)

(52) U.S. Cl. ..... 439/63; 439/581; 439/487

(58) Field of Classification Search ..... 439/63, 439/581, 582, 583, 584, 585, 486
See application file for complete search history.

(56) References Cited

U.S. PATENT DOCUMENTS 4,502,749 A * 3/1985 Forney et al. ..... 439/581
4,795,352 A * 1/1989 Capp et al. ..... 439/63
4,964,805 A * 10/1990 Gabany ..... 439/63
5,344,340 A * 9/1994 Bouleau ..... 439/581
5,899,754 A 5/1999 Beloritsky et al.
2002/0142625 A1* 10/2002 Berghorn et al. ..... 439/63

* cited by examiner

*Primary Examiner*—Hien Vu
(74) *Attorney, Agent, or Firm*—Sacco & Associates, PA

(57) ABSTRACT

A durable coaxial connector (100) for providing a reliable signal connection to a printed circuit board (PCB) (118) while isolating the PCB from mechanical loads that are applied to the connector, and an electrical system incorporating the same. The connector can include a connector body (102) having a connector interface member (106), at least one flange (104), and a ground interface member (304) having a first portion (306) configured to be fixedly attached to the PCB and a second portion (308) configured to slideably mate to a ground interface receptacle defined in the connector body. A connector interface can be defined on an inner surface (410) of the connector interface member. A fastener (124) can couple the connector body to a heat sink (112). A thermally conductive boss (116) can be provided to mount the connector body (102) and transfer thermal energy from the connector body to the heat sink.

13 Claims, 5 Drawing Sheets

COAXIAL CONNECTOR FOR CIRCUIT BOARDS

BACKGROUND OF THE INVENTION

1. Statement of the Technical Field

The inventive arrangements relate to coaxial connectors and, more particularly, to a coaxial connector for providing a signal connection to a printed circuit board.

2. Description of the Related Art

When assembling electrical systems it is often necessary to connect a coaxial cable to a printed circuit board (PCB) for propagation of high frequency signals to or from the PCB. Surface mount coaxial connectors are conventionally used to establish a reliable signal connection between the coaxial cable and the PCB. For example, male and female surface mount coaxial connectors are currently available in various configurations. The current state of the art connectors are not ideal, however, because such connectors are not designed to withstand significant mechanical loads. Consequently, PCBs are oftentimes damaged due to installation and removal of coaxial cables, motion of cables during shock and vibration, and clamping of cables during system assembly. Accordingly, a durable surface mount coaxial connector is needed which can withstand such mechanical loads and prevent damage to PCBs when such loads are applied.

SUMMARY OF THE INVENTION

The present invention relates to a durable coaxial connector (hereinafter "connector") for providing a reliable signal connection to a printed circuit board (PCB) while isolating the PCB from mechanical loads that are applied to the connector. The connector can include a connector body having a connector interface member suitable for mating with another connector. The connector also can include a flange, a ground interface receptacle and a ground interface member. The ground interface member can provide an electrically conductive ground path from the PCB to the connector interface member, and can include a first portion configured to be fixedly attached to a printed circuit board and a second portion configured to slideably mate to the ground interface receptacle. More particularly, the ground interface member can include a substantially cylindrical radial spring member, and at least one slot defined in the radial spring member. The slot can facilitate flexure of the radial spring member from a resiliently biased state to facilitate mating of the ground interface member with the ground interface receptacle.

The connector can include a conductive contact, such as a contact pin, coaxially aligned with respect to the ground interface member. In addition, a connector interface can be defined on an inner surface of the connector interface member. The conductive contact and connector interface can mate to a corresponding connector to support signal propagation between the connectors.

The connector also can include at least one fastener that secures the connector body to a heat sink. The heat sink can include a planar member and at least one boss extending from the planar member such that the flange and the planar member are separated by a distance defined at least in part by the boss. In another arrangement, the boss can extend from the flange of the connector body. In yet another arrangement, bosses can extend both from the planar member and the flange. The boss or bosses can be thermally conductive so as to transfer thermal energy from the connector body to the heat sink.

Another embodiment of the present invention can include an electrical system which includes the connector described herein.

DETAILED DESCRIPTION OF THE PREFERRED EMBODIMENTS

The present invention relates to a durable coaxial connector (hereinafter "connector") for providing a reliable signal connection to a printed circuit board (PCB) while isolating the PCB from mechanical loads that are applied to the connector. The present invention also relates to an electrical system which includes such a connector. In addition to having favorable thermal dissipation characteristics, the connector is designed to withstand significant mechanical loads. Accordingly, the connector can prevent damage to the PCB that often occurs from installation and removal of coaxial cables, motion of cables during shock and vibration, and clamping of cables during system assembly.

Figure 1:
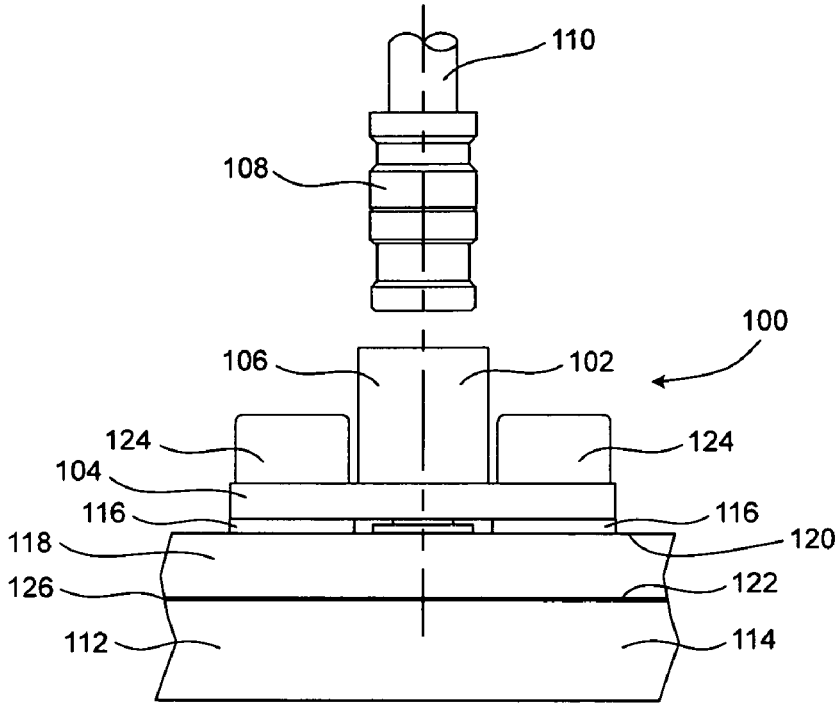
FIG. 1 is a side view of a coaxial connector which is useful for understanding the present invention.
Figure 2:
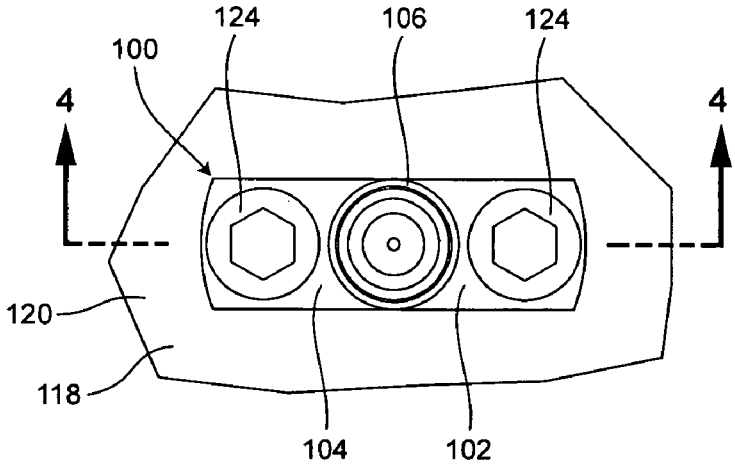
FIG. 2 is a top view of the coaxial connector of FIG. 1.

FIG. 1 is a side view of a connector 100 which is useful for understanding the present invention. A top view of the connector 100 is shown in FIG. 2. The connector 100 can include an electrically conductive connector body 102 that comprises at least one flange 104 and a connector interface member 106 for receiving a mating connector 108. The mating connector 108 can be attached to a coaxial cable 110, but the invention is not limited in this regard. Alternatively, the mating connector 108 can be attached to another type of electrical component.

A heat sink 112 also can be provided. The heat sink 112 can comprise a planar member 114 and one or more bosses 116 which extend from said planar member 114. The bosses 116 can, for instance, extend perpendicularly from the planar member 114 and define a distance of separation between the planar member 114 and the flange 104 of the connector body 102. Moreover, the bosses 116 can maintain the planar member 114 and the flange 104 substantially parallel. The bosses 116 can be thermally conductive so as to transfer thermal energy from the connector body 102 to the heat sink 112.

The connector body 102 and heat sink 112 can be positioned on opposing sides of a printed circuit board (PCB) 118. For instance, the connector body 102 can be disposed proximate to a first side 120 of the PCB 118 while the heat sink 112 can be disposed proximate to a second side 122 of the PCB 118. As used herein, the term "proximate" means near, adjacent, or in contact. For example, the connector body 102 may be near, adjacent, or in contact with the first side 120 of the PCB 118 and the heat sink 112 may be near, adjacent, or in contact with the second side 122.

One or more fasteners 124 can be provided to couple the connector body 102 to the heat sink 112. The fasteners 124 can be screws, bolts or any other fastener suitable for coupling the connector body 102 to the heat sink 112. As with the bosses 116, the fasteners also can be thermally conductive to aid transfer of thermal energy from the connector body 102 to the heat sink 112.

The fasteners 124 and bosses 116 also can transfer to the heat sink 112 any mechanical loads that are applied to the connector body 102. Notably, the heat sink can be mechanically secured to the PCB 118 over a large region. Accordingly, the mechanical loads applied to the connector body 102 can be spread over the large region, thus reducing the risk of damage to the PCB 118 when such loads are applied. In another arrangement, the heat sink 112 can be mechanically secured to an external structure (not shown) for convenience of securing the entire assembly. Such an arrangement also can insure that mechanical loads that are applied to the connector body 102 are transferred to the external structure via the heat sink 112.

A material layer 126 can be disposed between the heat sink 112 and the PCB 118. In one arrangement the material layer 126 can be a dielectric material to electrically insulate circuit traces that may be printed on the second side 122 of the PCB 118 from the heat sink 112. In another arrangement, the material layer 126 can be an electrically conductive material, such as a metal-filled adhesive or gasket, for purposes of conducting ground currents between the heat sink 112 and the PCB 118. In either of the two arrangements, the material layer 126 may be a thermal insulator to thermally isolate circuit traces that may be printed on the second side 122 of the PCB 118 from the heat sink 112, or the material layer 126 may be a thermal conductor so as to promote heat transfer between the PCB 118 and the heat sink 112. In yet another arrangement, different portions of the material layer 126 may have different thermal and/or electrical characteristics.

Figure 3:
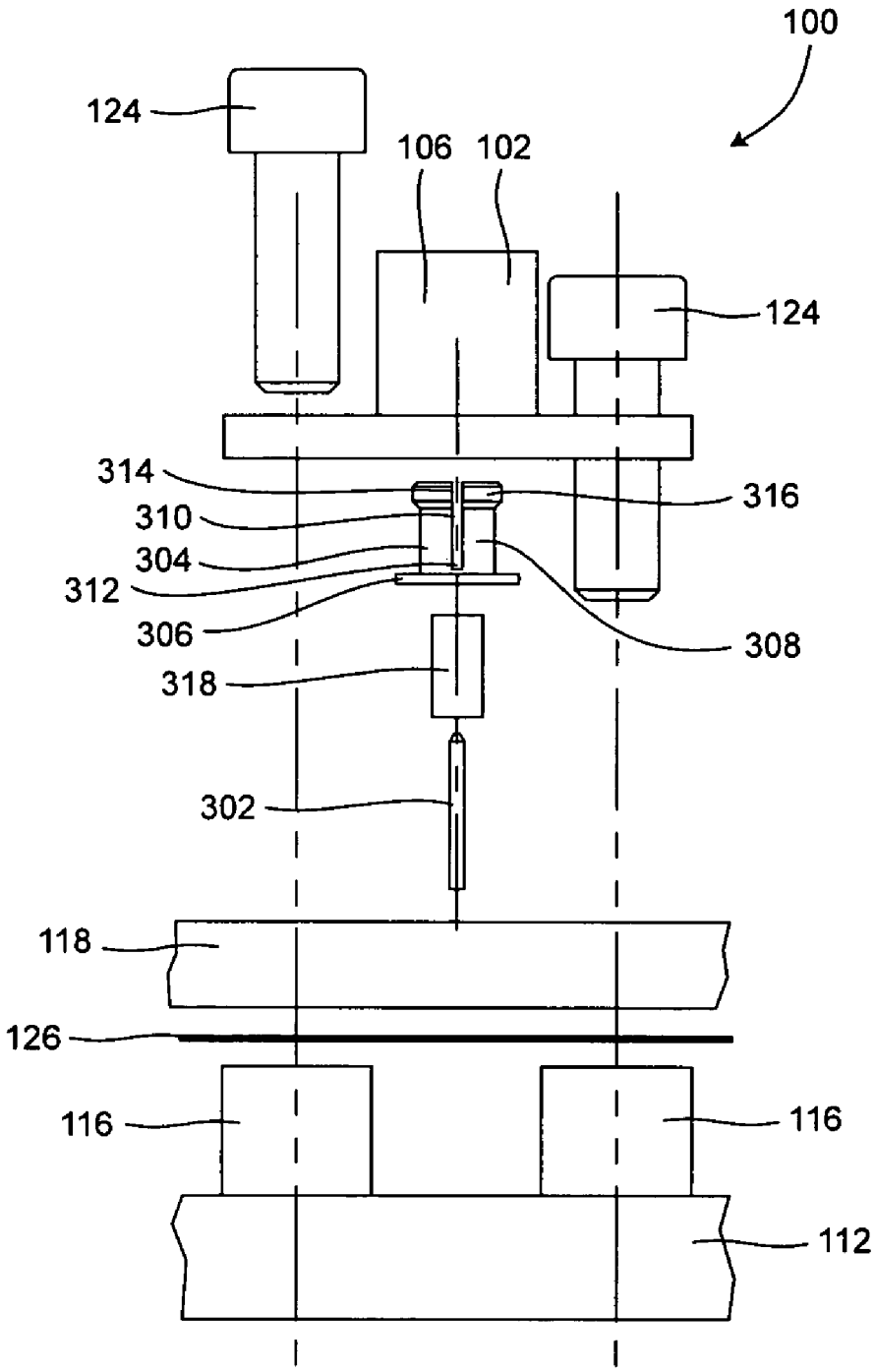
FIG. 3 is an exploded view of the coaxial connector of FIG. 1.

FIG. 3 is an exploded view of the connector 100. In addition to the connector body 102, heat sink 112 and fasteners 124, the connector also can include an electrically conductive contact, for instance contact pin 302. When the connector 100 is assembled, the contact pin 302 can be coaxially positioned within the connector interface member 106 and can be electrically continuous with an electrical conductor (not shown), such as a circuit trace defined in or on the PCB 118.

The connector also can include an electrically conductive ground interface member 304. The ground interface member 304 can include a circuit contact member 306 configured to be fixedly attached to the PCB 118 and a substantially cylindrical radial spring member 308. The radial spring member 308 can include at least one slot 310 defined from a first portion 312 of the radial spring member 308 to an end portion 314 of said radial spring member 308. The slot 310 can facilitate flexure of the radial spring member 308 from a resiliently biased state to facilitate mating of the ground interface member 304 with the connector body 102. The radial spring member 308 also can include at least one annular protrusion 316 for engaging the connector body 102 when inserted therein. The annular protrusion can be located at the end portion 314 of said radial spring member 308, or elsewhere on the radial spring member 308.

When the connector 100 is assembled, the ground interface member 304 can provide electrical continuity between the connector interface member 106 and an electrical conductor (not shown) defined in or on the PCB. For instance, the radial spring member 308 can engage the connector body 102, and the circuit contact member 306 can be secured to a ground trace or ground plane on the PCB 118. As with the contact pin 302, the ground interface member 304 also can be coaxially positioned within the connector interface member 106. A dielectric member 318 can be provided to insulate the contact pin 302 from the ground interface member 304. Further, the material layer 126 can be disposed between the heat sink 112 and the PCB 118. Holes or vias (not shown) can be formed into the material layer 126 and the PCB 118 through which the bosses 116 can be inserted.

Figure 4:
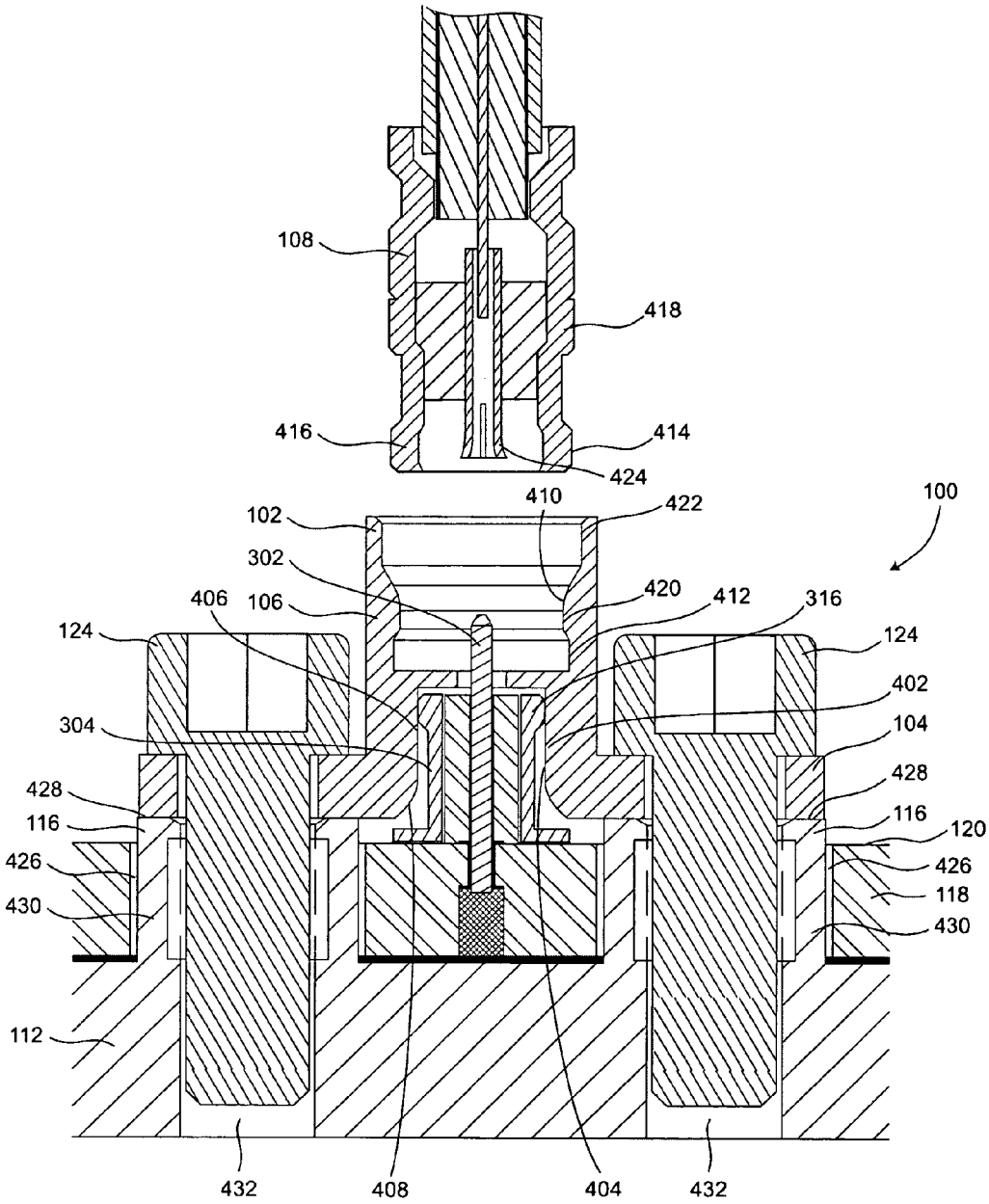
FIG. 4 is an enlarged cross-sectional view of the coaxial connector of FIG. 1, taken along line 4—4.

FIG. 4 is a cross-sectional view of the connector 100, taken along line 4—4. The connector body 102 can comprise a ground interface receptacle 402 into which the ground interface member 304 slidably mates. The ground interface receptacle 402 can be defined by a first inner surface 404 having a contour which engages the ground interface member 304. For example, a first portion 406 of the inner surface 404 can have a diameter that is slightly smaller than the diameter of the annular protrusion 316 in its resiliently biased state, thereby creating a slightly tight radial fit between the first portion 406 and the annular protrusion 316. The tight radial fit insures electrical continuity between the ground interface member 304 and the ground interface receptacle 402. A second portion 408 can be contoured to facilitate smooth entry of the ground interface member 304 into ground interface receptacle 402 when the ground interface member 304 and the interface receptacle 402 are mated. Notably, use of the ground interface member 304 and ground interface receptacle 402 can insure electrically conductive ground path to the connector interface member 102, even if the connector body is not flush against the PCB 118.

The connector interface member 106 also can comprise a second inner surface 410 having a contour which defines a connector interface for engaging the mating connector 108. For example, a first portion 412 of the inner surface 410 can have a diameter that is slightly smaller than the diameter of the annular protrusion 414 defined at an end portion 416 of a shell 418 of the mating connector 108. A second portion 420 of the inner surface 410 can have a diameter that is slightly smaller than the diameter of the annular protrusion 414 to facilitate retention of the mating connector 108 to the connector interface member 106. Further, a third portion 422 can be contoured to accommodate the mating connector 108. When the mating connector 108 is inserted into the connector interface member 106, a female contact 424 within the mating connector 108 can engage the contact pin 302 to provide electrical continuity between the respective contact pins 302, 424. Further, the shell 418 of the mating connector 108 can engage the inner surface 410 of the connector interface member 106 to provide electrical continuity therebetween. Notably, the invention is not limited to this embodiment. For example, the mating connector may be comprised of a dielectric member and a female contact member coaxially disposed within a threaded coupling nut. The connector interface member may be suitably configured to accommodate the mating connector.

In the embodiment shown, the bosses 116 can extend through vias 426, or holes, defined within the PCB 118 and beyond the first surface 120 of the PCB 118. This arrangement can be used to provide secure mounting of the connector body 102 without the connector body having rigid contact with the PCB 118, thus minimizing mechanical stresses on the PCB 118 when mechanical loads are applied to the connector body 102, for instance when cables are being attached to the connector 100. Moreover, this arrangement can insure that the bosses will still make direct contact with the flange 104 of the connector body 102 while accounting for variations in PCB thicknesses. It should be noted, however, that the invention is not limited in this regard and that the top surfaces 428 of the bosses may be flush with the first surface 120 of the PCB 118.

In one arrangement, each of the bosses 116 can be configured to have a hollow body 430 through which the fasteners 124 can be inserted. In this arrangement, the fasteners 124 can be secured to the heat sink, for example into threaded holes 432, or secured with external fasteners, such as nuts. Alternatively, the bodies 430 of the bosses 116 can be configured to define respective threaded holes into which the fasteners 124 can be secured. Nonetheless, there are a myriad of other techniques that can be used to secure connector body 102 to the heat sink 112 and the invention is not limited in this regard.

Figure 5:
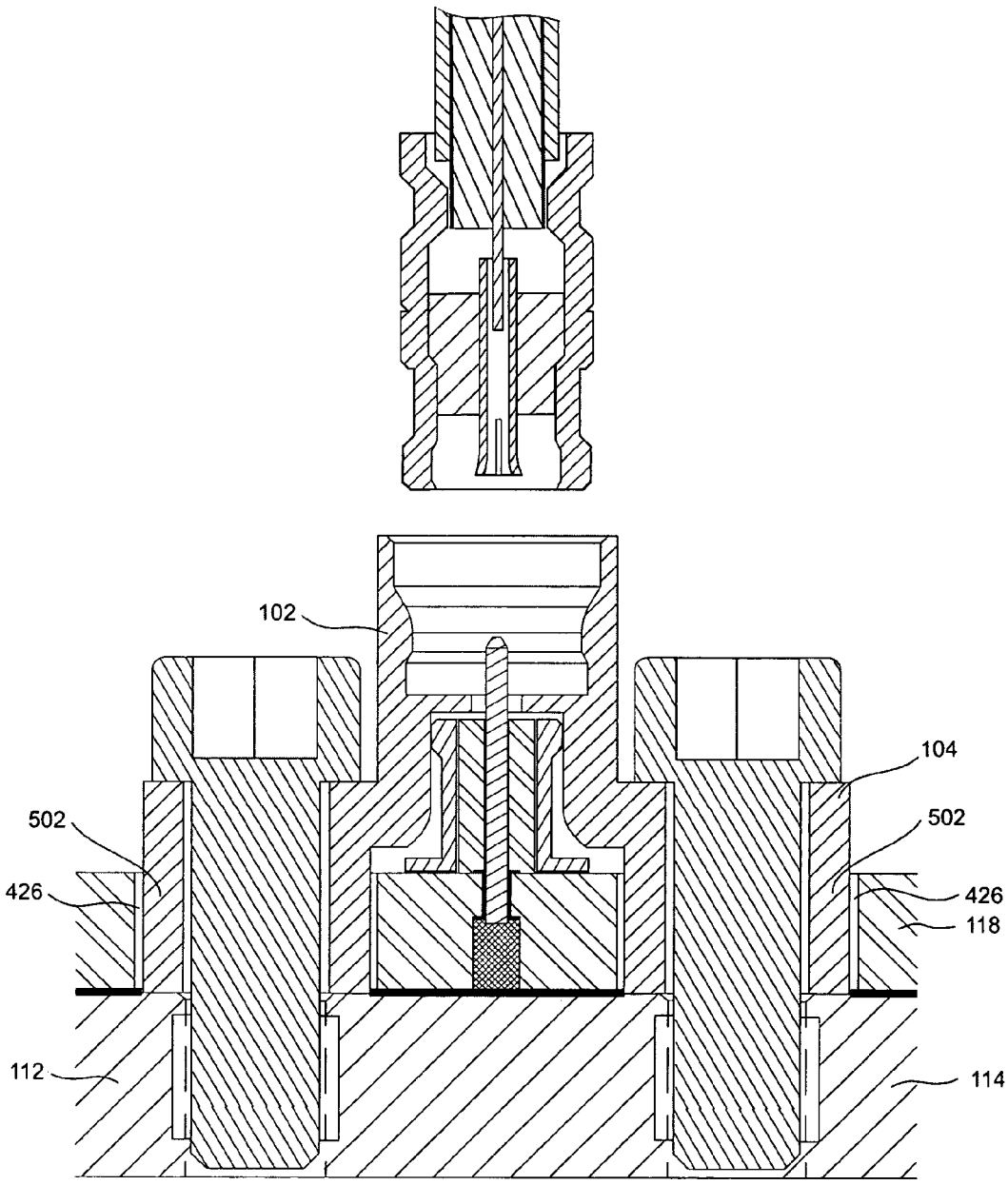
FIG. 5 is an enlarged cross-sectional view of an alternative embodiment of the coaxial connector of FIG. 1, taken along line 4—4.

FIG. 5 is a cross-sectional view of an alternative embodiment of the coaxial connector of FIG. 1, taken along line 4—4. In this arrangement, rather than being attached to the heat sink 112, bosses 502 are part of the flange 104 of the connector body 102. The bosses 502 can extend through the vias 426 in the substrate 118 to make contact with the planar member 114 of the heat sink 112, thereby providing thermal conductivity and electrical contact, if desired, between the connector body 102 and the heat sink 112.

Figure 6:
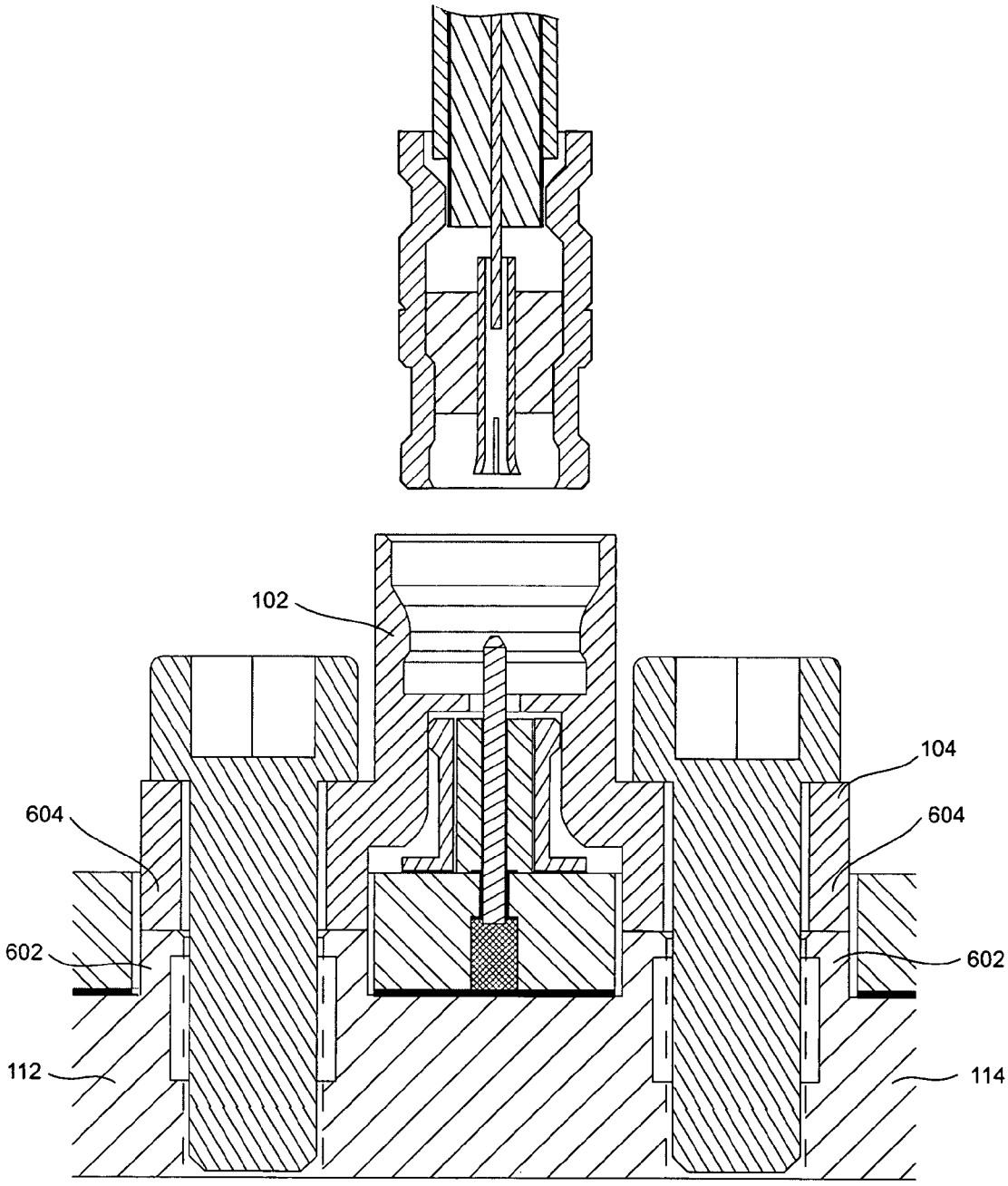
FIG. 6 is an enlarged cross-sectional view of yet another embodiment of the coaxial connector of FIG. 1, taken along line 4—4.

FIG. 6 is a cross-sectional view of yet another embodiment of the coaxial connector of FIG. 1, taken along line 4—4, in which bosses 602 are included on the planar member 114 of the heat sink 112 and bosses 604 are included on the flange 104 of the connector body 102. In the arrangement, the bosses 602 can engage the bosses 604 to provide thermal conductivity and electrical contact, if desired, from the connector body 102 to the heat sink 112.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A coaxial connector comprising:

a connector body comprising a connector interface member, a flange and a ground interface receptacle;

a ground interface member comprising a first portion configured to be fixedly attached to a printed circuit board and a second portion configured to slideably mate to said ground interface receptacle, said ground interface member comprises a substantially cylindrical radial spring member and at least one slot defined in said radial spring member, wherein said at least one slot facilitates flexure of said radial spring member from a resiliently biased state to facilitate mating of said ground interface member with said ground interface receptacle; and a conductive contact coaxially aligned with respect to said ground interface member.

2. The coaxial connector of claim 1, wherein said ground interface member provides an electrically conductive ground path to said connector interface member.

3. The coaxial connector of claim 1, wherein said boss is thermally conductive so as to transfer thermal energy from said connector body to said heat sink.

4. The coaxial connector of claim 1, further comprising a connector interface defined on an inner surface of said connector interface member.

5. A coaxial connector comprising:

a connector body comprising a connector interface member, a flange and a ground interface receptacle;

a ground interface member comprising a first portion configured to be fixedly attached to a printed circuit board and a second portion configured to slideably mate to said ground interface receptacle;

a conductive contact coaxially aligned with respect to said ground interface member;

at least one boss which extends from said flange; and at least one fastener that secures said connector body to a heat sink comprising a planar member such that said flange and said planar member are separated by a distance defined at least in part by said boss.

6. The coaxial connector of claim 5, wherein said boss is thermally conductive so as to transfer thermal energy from said connector body to said heat sink.

7. An electrical system comprising:

a printed circuit board comprising:

a first surface;

a second surface substantially parallel to said first surface;

at least one via defined within said printed circuit board;

a coaxial connector comprising:

a connector body comprising a connector interface member, a flange and a ground interface receptacle;

a ground interface member comprising a first portion configured to be fixedly attached to said first surface of said printed circuit board and a second portion configured to slideably mate to said ground interface receptacle, said ground interface member further comprises a substantially cylindrical radial spring member, at least one slot defined in said radial spring member, wherein said at least one slot facilitates flexure of said radial spring member from a resiliently biased state to facilitate mating of said ground interface member with said ground interface receptacle; and a conductive contact coaxially aligned with respect to said ground interface member.

8. The electrical system of claim 7, wherein said ground interface member provides an electrically conductive ground path to said connector interface member.

9. The electrical system of claim 7, further comprising a connector interface defined on an inner surface of said connector interface member.

10. The electrical system of claim 7, further comprising:

a heat sink comprising a planar member and at least one boss extending from said planar member;

at least one fastener that secures said connector body to said heat sink such that said flange and said planar member are separated by a distance defined at least in part by said boss.

11. The electrical system of claim 10, wherein said boss is thermally conductive so as to transfer thermal energy from said connector body to said heat sink.

12. An electrical system comprising:

a printed circuit board comprising:

a first surface;

a second surface substantially parallel to said first surface;

at least one via defined within said printed circuit board;

a coaxial connector comprising:

a connector body comprising a connector interface member, a flange and a ground interface receptacle;

a ground interface member comprising a first portion configured to be fixedly attached to said first surface of said printed circuit board and a second portion configured to slideably mate to said ground interface receptacle;

a conductive contact coaxially aligned with respect to said ground interface member;

at least one boss extending from said flange;

a heat sink comprising a planar member; and at least one fastener that secures said connector body to said heat sink such that said flange and said planar member are separated by a distance defined at least in part by said boss.

13. The coaxial connector of claim 12, wherein said boss is thermally conductive so as to transfer thermal energy from said connector body to said heat sink.

* * * * *